United States Patent [19]

Donaldson et al.

[11] 4,444,422

[45] Apr. 24, 1984

[54] SASH LOCK

[75] Inventors: James R. Donaldson; Kurt Koberstein, both of Winnipeg, Canada

[73] Assignee: Storm-Tite Industries, Ltd., Winnipeg, Canada

[21] Appl. No.: 366,065

[22] Filed: Apr. 6, 1982

[51] Int. Cl.[3] ..... E05C 1/12

[52] U.S. Cl. ..... 292/169; 292/DIG. 47; 292/DIG. 70

[58] Field of Search ..... 292/DIG. 46, DIG. 47, 292/DIG. 70, 169, 169.19, 169.21, 169.22, 292/169.23, 169.11–169.17, 164, 170

[56] References Cited

U.S. PATENT DOCUMENTS

| | | | |
|---|---|---|---|
| 699,223 | 5/1902 | Neher et al. | 292/169.15 |
| 963,012 | 6/1910 | Seisler | 292/169.22 |
| 1,021,417 | 3/1912 | Mason | 292/169.14 |
| 2,674,481 | 4/1954 | Russell et al. | 292/169.19 |
| 3,767,241 | 10/1973 | Orr | 292/169.15 |
| 3,984,136 | 10/1976 | Bills | 292/DIG. 46 X |
| 4,146,256 | 3/1979 | Snider et al. | 292/DIG. 47 X |

FOREIGN PATENT DOCUMENTS

| | | | |
|---|---|---|---|
| 292494 | 10/1948 | Switzerland . | |
| 523821 | 7/1940 | United Kingdom | 292/169.21 |

*Primary Examiner*—Gary L. Smith
*Assistant Examiner*—R. Illich
*Attorney, Agent, or Firm*—Murray Schaffer

[57] ABSTRACT

A sash lock for sliding windows as for example in vehicles such as buses is provided. The lock has a minimum of moving parts (two), and great strength. The lock comprises a lock body having a projecting latch plate which is adapted to engage a slot in a track adjacent a sliding window. The latch plate has an upper unitary lip which is engaged by downwardly projecting members on the latch handle, and there is an associated spring normally urging the latch plate toward the slotted track. Pivotal movement of the handle, in either direction, causes the latch plate to be released from the slotted track so that the latch and its associated window may readily be moved along the track.

2 Claims, 6 Drawing Figures

SASH LOCK

The invention relates to a sash lock particularly for use in horizontally sliding windows as found on motor vehicles such as passenger buses and the like, although it will be evident that the lock according to the invention will find utility in other analogous applications.

The sash lock according to the invention comprises a minimum number of parts, and has been designed to provide maximum durability, and to withstand rough use, as is frequently encountered in public transit vehicles or the like.

The sash lock assembly disclosed herein is adapted to be bolted or otherwise affixed to the frame on a sliding window, and includes latch means adapted for engagement in a slotted track or the like adjacent the window track.

The sash lock includes a pivot release mechanism, which acts to release the latch, the pivot release mechanism being capable of being pivoted in a downward direction on either side of the lock, so as to permit the user to simultaneously release the lock, and to slidably open or close the associated window.

Searches have been conducted among classified patents as found in the Canadian and United States Patent Offices, and of the patents reviewed the only one of any apparent relevance is U.S. Pat. No. 4,146,256 issued Mar. 27, 1979 to Ellcon-National, Inc. This United States patent, however, is directed to a latch assembly which is designed to permit panic opening of a vehicle window which is hinged horizontally, and is designed to pivot outwardly, so as to permit passengers to exit from a vehicle in emergency situations. Further, the latch mechanism of U.S. Pat. No. 4,146,256 involves a relatively large number of parts, including a pair of relatively fragile U-springs, and a pair of rotatable levers having projecting fingers, which are capable of rotation by the handle of this device. Thus, there are many more moving parts required in the assembly of U.S. Pat. No. 4,146,256, with the inevitable increase in likelihood of breakdown during heavy use.

Applicant's structure, on the other hand, includes the bare minimum of moving parts (two) and is of such sturdy construction that extremely long life is permitted. Further, the sash lock of the subject invention is designed to make opening and closing of a horizontally sliding vehicle window extremely simple for the user, by pressing down on the handle, and forwardly in the direction it is desired to move the window. In the prior art device it is necessary first to push down on the actuating handle, and then outwardly on the window, to effect movement thereof.

It is an object of the invention to provide a sash lock constructed of a minimum number of parts, and which is extremely sturdy, and convenient to use, and at the same time is relatively inexpensive.

A principal object of the invention is to provide a sash lock adapted to be affixed to a sliding window adjacent an adjoining slotted track; a body member having a latch plate projecting therefrom, for selective engagement with a slot in said slotted track, said latch plate having a unitary upper lip; a handle on said body having a unitary, downwardly depending member with a latch release lug on each side of the lower edge thereof adapted for engagement with said lip on said latch plate, said handle being pivotally mounted on said body; a spring means normally urging said latch plate toward said slotted track; whereby manual pivoting of said handle will cause one of said latch release lugs to urge said lip and its latch plate away from said slotted track against the urging of said spring, so as to permit sliding of said window along said track.

These and other objects of the invention will become apparent with reference to the following description.

In the attached drawings.

Detailed reference will now be made to the accompanying drawings, wherein like reference numerals will identify like parts.

Figure 1:
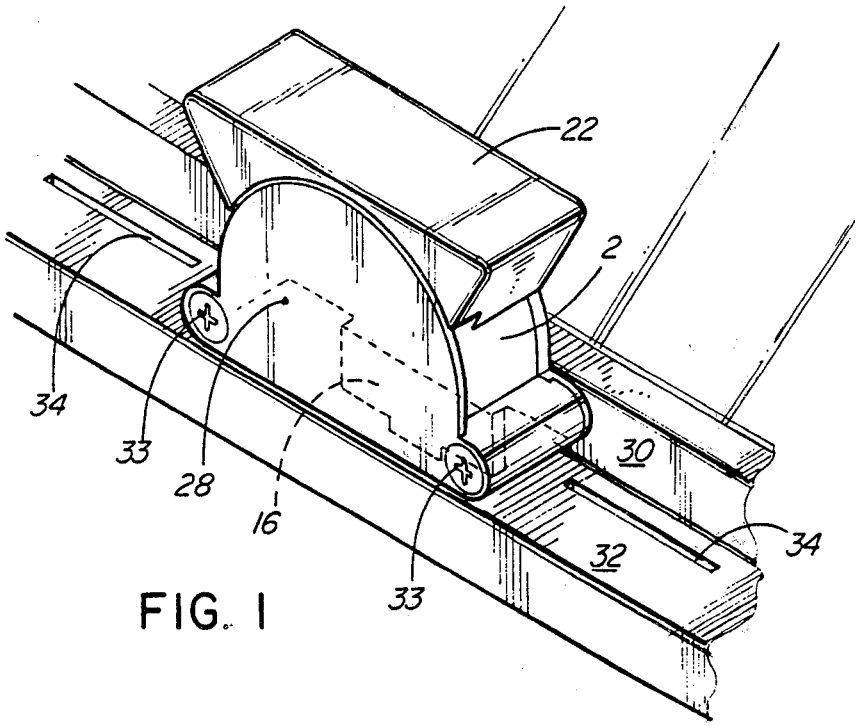
FIG. 1 is an isometric view, partly in ghost, of a sash lock mounted on a horizontally sliding window, and includes a partial view of the window track.

The lock is comprised of a main body 2, having a semi-circular upper surface 4, and an interior compartment including unitary vertical flat side walls 6. Each of side walls 6 has a horizontal indentation 8, near the top thereof (see FIG. 4) adapted to receive the end of a horizontal spring retainer bar 10, having a spring retaining finger 12, adapted to receive one end of a coil spring 14. A rectangular latch plate 16 having an upper lip 18 is provided with a circular hole 20 centrally in the top thereof, adapted to receive the other end of coil spring 14, coil spring 14 thus normally urging latch plate 16 downwardly away from spring retainer bar 10.

A lock release handle 22 projects upwardly above the main lock body 2, handle 22 having a flat upper surface, with curved ends, and a bottom surface which is curved arcuately, to conform with the upper surface of latch body 2.

Figure 2:
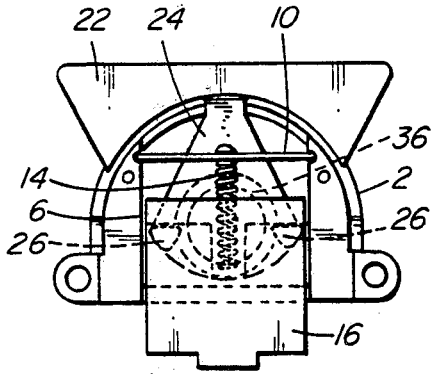
FIG. 2 is an end elevation, with the lock back-plate removed, the lock being in its locked position.
Figure 4:
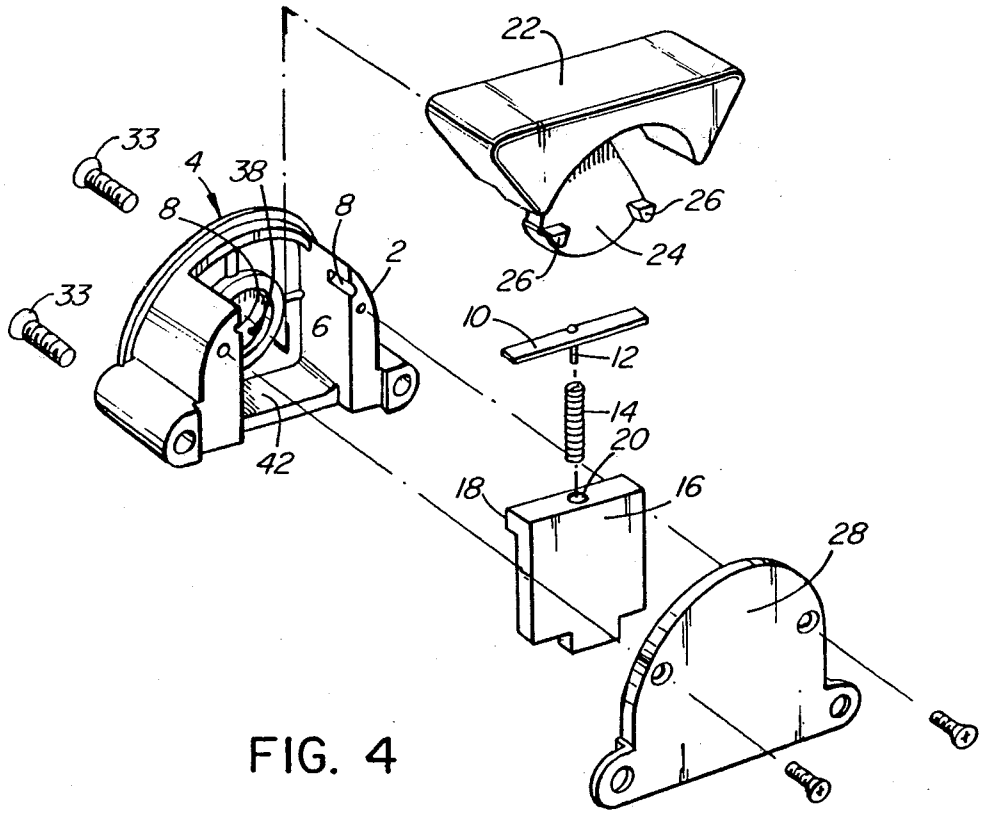
FIG. 4 is an exploded view of the sash lock.

As seen most clearly in FIG. 4, handle 22 includes a unitary, downwardly-extending latch release finger 24 of generally triangular configuration, with a rounded bottom surface. A pair of latch release lugs 26 project from the inner side of triangular finger 24, lugs 26 engaging the underside of lip 18 of latch plate 16, as seen most clearly in FIG. 2. (See also FIG. 6).

The latch assembly is enclosed by a back plate 28, as illustrated in FIGS. 1 and 4.

Referring to FIG. 1, it will be seen that the latch assembly is mounted on the bottom frame 30 of a sliding sash window, as for example, by means of threaded bolts 33. The window track 32 adjacent sash frame 30 is provided with a plurality of spaced-apart longitudinal slots 34, adapted to receive the bottom edge of lock plate 16, whereby a sliding sash window may be selectively locked in any desired position along track 32, with lock plate 16 engaging the selected groove 34 in track 32.

Figure 3:
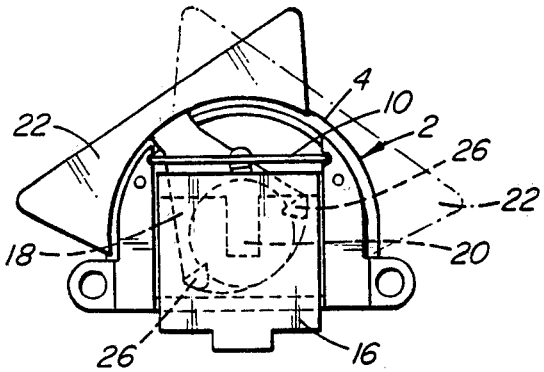
FIG. 3 is an end elevation with parts removed for purposes of simplicity, with the lock shown in open position.

Thus, to release the lock assembly, handle 22 is pivoted either to the direction shown in solid lines in FIG. 3, or the position shown in broken lines in FIG. 3, causing one of lugs 26 on triangular finger 18 to urge the lip 18 of latch plate 16 upwardly against the action of spring 14, releasing the bottom edge of spring plate 16 from within one of grooves 34, to permit the window to be moved horizontally, with manual horizontal pressure on handle 16. Release of handle 16 will result in its return to the position illustrated in FIGS. 1 and 2, with latch plate 16 being urged downwardly under the action of spring 14, whereby the bottom edge thereof engages within one of grooves 34.

Figure 5:
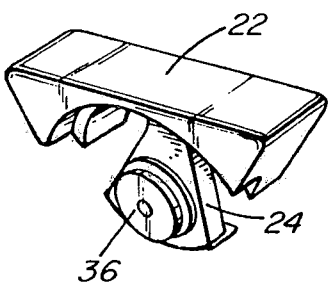
FIG. 5 is an isometric view of the handle member of a sash lock.

As seen most clearly in FIG. 5, latch release finger 24 has unitary, central, circular projection 36 on the face thereof remote from latch release lugs 26, circular projection 36 being adapted for rotatable restraint within circular recess 38 on the interior face of main lock body 2 (see FIG. 4).

Figure 6:
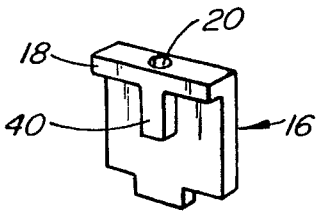
FIG. 6 is an isometric view of the latch plate of the lock.

Referring to FIG. 6 it will be seen that latch plate 16 has a unitary vertical projection 40 depending downwardly from upper lip 18, projection 40 acting as a stop, adapted to abut against the bottom wall 42 of body 2 (see FIG. 4). Thus, under the urging of spring 14 latch plate 16 is restrained from downward movement by stop member 40.

Accordingly, in operation as lock release handle 22 is pushed manually downwardly in either direction lock release handle 22 pivots on projection 36, within recess 38 of body member 2, and simultaneously, one of latch release lugs 26 will ride upwardly against lip 18 of latch plate 16, to raise latch plate 16 against the urging of spring 14, to disengage latch plate 16 from within track slot 34, and when held in this position, the sash lock, and associated window 30 may readily be moved in a horizontal position along window track 32.

The foregoing is by way of example and the invention should be limited only by the scope of the appended claims.

The embodiments of the invention in which an exclusive property or privilege is claimed are defined as follows:

1. A sash lock adapted to be affixed to a sliding window adjacent an adjoining slotted track;

a body member having an interior compartment including unitary vertical flat side walls, each of said side walls having a horizontal indentation therein near the top thereof, adapted to receive the ends of a horizontal spring retainer bar, having a central downwardly depending spring retainer finger;

a rectangular latch plate having a unitary upper lip and a central hole in the top of said lip, adapted to receive one end of a coil spring, the other end of said coil spring being retained by said spring retainer finger on said retainer bar, said spring normally urging said latch plate away from said retainer bar;

a handle on said body having a unitary, downwardly depending member with a latch release lug on each side of the lower edge thereof adapted for engagement with said lip on said latch plate, said handle being pivotally mounted on said body by a unitary circular projection on said downwardly depending member, adapted for rotatable restraint within a circular recess on the interior of said body member, whereby said handle is pivotally mounted on said body;

and a unitary stop member provided on said latch plate, to limit movement thereof away from said spring retainer bar.

2. A sash lock according to claim 1, said handle having a flat upper surface with curved ends, and a bottom surface which is curved arcuately, said body member having a curved upper surface conforming therewith.

* * * * *